US006209249B1

(12) United States Patent
Borden

(10) Patent No.: US 6,209,249 B1
(45) Date of Patent: Apr. 3, 2001

(54) BOLT FOR FIREARM ALLOWING FOR REDUCED CLEARANCE BETWEEN BOLT AND BOLT RUNWAY

(76) Inventor: James F. Borden, Borden Accuracy, R.R. #1 Box 250 BC, Springville, PA (US) 15544

( * ) Notice: Subject to any disclaimer, the term of this patent is extended or adjusted under 35 U.S.C. 154(b) by 0 days.

(21) Appl. No.: 09/268,734

(22) Filed: Mar. 17, 1999

(51) Int. Cl.[7] ..... F41A 3/30
(52) U.S. Cl. ..... 42/16; 42/25; 42/16
(58) Field of Search ..... 42/16, 25, 69.02; 89/26

(56) References Cited

U.S. PATENT DOCUMENTS

| | | | |
|---|---|---|---|
| 36,852 | 11/1862 | Nye . | |
| 1,198,380 | 9/1916 | Hammond . | |
| 2,159,485 | 5/1939 | Loomis . | |
| 2,425,684 | 8/1947 | Patchett . | |
| 2,861,374 | 11/1958 | Hampton . | |
| 2,941,449 | 6/1960 | Reed . | |
| 3,631,620 | 1/1972 | Ohira . | |
| 3,710,492 | 1/1973 | Tirrell . | |
| 5,551,179 | 9/1996 | Young . | |
| 5,926,988 * | 7/1999 | Casull | 42/25 |

FOREIGN PATENT DOCUMENTS

| | | |
|---|---|---|
| 2207493 | 2/1989 | (GB) . |

* cited by examiner

*Primary Examiner*—Michael J. Carone
*Assistant Examiner*—Troy Chambers
(74) *Attorney, Agent, or Firm*—Richard C. Litman

(57) ABSTRACT

A bolt for a firearm has a front and rear portion with increased diameter front and rear bosses, thereby allowing for reduced clearance between the bolt and bolt runway. The front boss has major and minor diameter portions, with the major diameter portions being located directly behind the locking lugs, and the minor diameter portions being equal in diameter to the rest of the bolt body. The rear boss is located directly in front of the handle, and has a uniform diameter equal to the major diameter of the front boss.

9 Claims, 6 Drawing Sheets

BOLT FOR FIREARM ALLOWING FOR REDUCED CLEARANCE BETWEEN BOLT AND BOLT RUNWAY

BACKGROUND OF THE INVENTION

1. Field of the Invention

The present invention is a bolt for a bolt action rifle having front and rear bosses with a diameter slightly larger than the rest of the bolt body, thereby allowing for a tighter tolerance between the bolt and bolt runway, and improving accuracy.

2. Description of the Related Art

Bolt action rifles have existed since the later part of the nineteenth century. Although other action types have been developed, frequently offering greater speed for following shots, bolt actions remain popular for their unequalled reputation for strength and accuracy. Their widespread use has led many inventors to propose various ways to improve their overall operation and accuracy. Additionally, the reciprocating member of other action types has come to be known as a "bolt," and some improvements to these actions is discussed below.

Although present bolt action rifles are highly regarded for their accuracy potential, they are not without room for improvement. Standard bolts have a uniform diameter over the entire length of their body, with the exception of the locking lugs in front and the bolt handle in the rear. The clearance between a standard bolt and the bolt runway is a compromise between accuracy, which is achieved by reducing the clearance, and smooth operation of the bolt, which is achieved by increasing the clearance to prevent foreign particles from binding the bolt. The present invention addresses both issues by providing a bolt having a front and rear boss with a slightly larger diameter than the bolt body, thereby allowing for a tighter tolerance between the bolt and bolt runway without causing the bolt to bind.

An early example of a rifle having a bolt is U.S. Pat. No. 36,852, issued to John C. Nye on Nov. 4, 1862, which describes a breech-loading firearm. The firearm includes a sliding bolt held in place by a hinged latch passing through both a hole in the barrel and a corresponding hole in the bolt.

U.S. Pat. No. 1,198,380, issued to Grant Hammond on Sep. 12, 1916, describes a breech bolt for firearms. The bolt includes top and bottom lugs in front, an ejector channel, and an extractor. A handle is located at the rear of the bolt. The bolt is operated by lifting the handle upward, and then pulling it rearward to open the breech. Pushing the bolt handle forward and then downward closes the breech.

At least two inventors have proposed safety improvements for bolt action rifles. U.S. Pat. No. 2,159,485, issued to Crawford C. Loomis on May 23, 1939, describes a bolt action rifle having a bolt with a cocking handle and striker connected by a spring. A blow to the cocking handle will therefore be softened before being transmitted to the striker, thereby reducing the possibility of accidental discharge. Additionally, U.S. Pat. No. 3,631,620, issued to Banri Ohira on Jan. 4, 1972, describes a bolt wherein the sear and cocking piece are not in contact when the bolt is unlocked, but are brought into contact only when the bolt is completely locked.

U.S. Pat. No. 3,710,492, issued to Frank B. Tirrell on Jan. 16, 1973, describes a travel guide for bolt action rifles. The guide is located behind the locking lugs, and travels in a slot parallel to the direction of bolt travel. When the bolt is locked, the locking lugs are vertical and the travel guide remains horizontal. When the bolt is unlocked, the locking lugs are horizontal and in the same plane as the guide. One locking lug travels in a slot on the left side of the rifle, and the guide travels in a slot below the ejection port. This prevents binding of the bolt when the locking lug on the right side travels across the ejection port and can not be guided by a slot.

In addition to bolt actions, bolts for automatic and semi-automatic rifles have been the subject of inventive efforts. For example, U.S. Pat. No. 2,941,449, issued to Frederick P. Reed on Jun. 21, 1960, describes a decelerating device for firearms with telescoping bolts. The bolt includes a nonrotatable carrier and a rotatable head. The head includes a plurality of locking lugs. The head also includes a follower protruding through a diagonal slot on the carrier. As the bolt reaches the chamber, the locking lugs pass through a recess between a plurality of cam surfaces in the decelerator at the breech end of the barrel. When the head reaches its limit of travel, the carrier is still traveling forward. The follower within the carrier's diagonal slot causes the head to rotate so that the locking lugs engage the cam surfaces within the barrel. A similar invention is described in U.K. Pat. App. No. 2,207,493, filed by Sterling Armament Company Ltd. for an invention by Frank E. Waters and published on Feb. 1, 1989.

At least two inventors have proposed the use of lands and grooves on the exterior surface of a bolt for a semiautomatic or automatic rifle. U.S. Pat. No. 2,425,684, issued to George William Patchett on Aug. 12, 1947, describes a bolt having helical lands on its outside surface. The helical lands force foreign particles out the slot wherein the cocking handle travels. Additionally, U.S. Pat. No. 5,551,179, issued to Daniel H. Young on Sep. 3, 1996, describes a bolt carrier for an AR-15 or M-16 rifle having an increased number of lands and grooves. Mr. Young claims that the increased number of lands results in better bolt carrier alignment and better retention of lubricant.

Lastly, U.S. Pat. No. 2,861,374, issued to Samuel L. Hampton on Nov. 25, 1958, describes a bolt for a slide action rifle. The bolt includes a firing pin tube and three concentric sleeves, with the central sleeve having four inwardly biased fingers with locking heads on their front ends. The innermost sleeve is attached to the forestock sleeve. Pushing the forestock sleeve forward first moves the bolt forward, chambering a cartridge, and then pushes the inner sleeve against the central sleeve, thereby pushing the fingers outward and the locking heads into a groove within the rifle's receiver, locking the bolt in the closed position until the forearm sleeve is moved rearward.

No invention within the knowledge of the present inventor has addressed the problem of optimizing the firing accuracy of a bolt action rifle while preventing binding by providing increased diameter bosses at the front and rear of the bolt. None of the above inventions and patents, taken either singularly or in combination, is seen to describe the instant invention as claimed. Thus a bolt for firearm allowing for reduced clearance between bolt and bolt runway solving the aforementioned problems is desired.

SUMMARY OF THE INVENTION

The invention is a bolt having an increased diameter at the rear section immediately in front of the handle, and at the front section immediately behind the locking lugs, hereinafter called a boss. These bosses allow for a tight tolerance between the bolt runway and the bolt, thereby increasing accuracy.

A standard bolt for a bolt action rifle has a body with a uniform diameter. The rear portion of the bolt includes a handle for operating the bolt, and the front portion includes locking lugs mating with the action adjacent to the barrel, for securing the bolt in place during firing. The locking lugs on a standard rifle may number 2, 3, 4, or even 9, and the present invention will function with any of the above numbers of lugs, or any other number. A firing pin assembly passes through the center of the bolt, and is brought into contact with the trigger mechanism of the firing pin when the bolt is fully closed and locked. The bolt may also include an extractor for hooking the rim of a cartridge case to extract it from the rifle's chamber, and/or an ejector for knocking a cartridge case out of the rifle during reciprocation of the bolt.

The rear boss is a section of the bolt body immediately in front of the bolt handle having a diameter slightly larger than the remainder of the bolt body. The rear boss has either a uniform or eccentric diameter, which is preferably less than or equal to 0.001 inch less than the diameter of the bolt runway, resulting in a clearance of less than or equal to 0.0005 inch between the boss and the runway. In use, the rear boss secures the rear of the bolt when the bolt is pushed fully forward, but exits the action as soon as the bolt is slightly retracted. The rear boss therefore travels outside the action for most of the bolt's reciprocating motion, so that the rear portion of the action contains the smaller diameter bolt body, thereby reducing binding during bolt cycling.

The front boss is located directly behind the locking lugs. The front boss comprises both major diameter sections, and minor diameter sections. The major diameter sections are limited to those portions of the bolt body directly behind the locking lugs, with those portions between the locking lugs being of the minor diameter. The major diameter boss sections therefore travel within the locking lug channels during forward or backward motion of the bolt, thereby reducing binding. When the bolt is rotated to the locked position, the major diameter portions are rotated against bearing surfaces within the action, thereby securing the front of the bolt in position. The major diameter sections are preferably equivalent to the diameter of the rear boss, and are therefore less than or equal to 0.001 inch less than the diameter of the bolt runway, resulting in less than or equal to 0.0005 inch of clearance between the boss and the runway. The minor diameter is preferable equivalent to the diameter of the remainder of the bolt body. A common example of a front and rear boss major diameter is 0.7015 inch.

As the bolt is cycled, the handle is rotated upwards, aligning the front boss with the locking lug channels, thereby increasing the clearance between the boss and the bolt runway to reduce binding as the action cycles. Pulling the bolt rearward disengages the rear boss from the rear portion of the bolt runway, thereby increasing the clearance between the bolt and runway. This maximized clearance exists for most of the bolt's cycle, maximizing the amount of space available to any foreign particles which may have entered the action, thereby minimizing any chance of binding. As the bolt is pushed forward, the rear boss is brought into contact with the rear of the bolt runway, thereby minimizing the clearance between the rear of the bolt and the bolt runway. When the bolt handle is rotated downward, the front boss is aligned away from the locking lug channels and against the bearing surfaces, thereby minimizing the clearance between the front of the bolt and the bolt runway. This minimized clearance ensures optimum accuracy during firing.

The bolt's body may include flutes to enhance the appearance of the bolt, and these flutes may assist in pushing foreign particles out of the action during bolt cycling. Straight flutes, should not be used, because of their well known propensity to contribute to binding when foreign particles are present. Wavy, spiral, or herringbone pattern flutes have been found to produce satisfactory results. Unfluted bolts have also been found to work well.

Accordingly, it is a principal object of the invention to provide a bolt having minimum clearance between the bolt and bolt runway when in the fully closed and locked position, thereby enhancing accuracy.

It is another object of the invention to provide a bolt having increased clearance between the bolt and bolt runway when the bolt is unlocked and reciprocating, thereby reducing binding.

It is a further object of the invention to provide a bolt having front and rear bosses, with the front boss having a major diameter directly behind the locking lugs, and a minor diameter between major diameter sections, and the rear boss having a uniform major diameter.

Still another object of the invention is to provide a bolt having sufficient clearance during reciprocation so that foreign particles do not cause the bolt to bind.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a bolt for a bolt action rifle having front and rear bosses with increased diameters, thereby decreasing the clearance between the bolt and bolt runway without increasing bolt binding.

Figure 7:
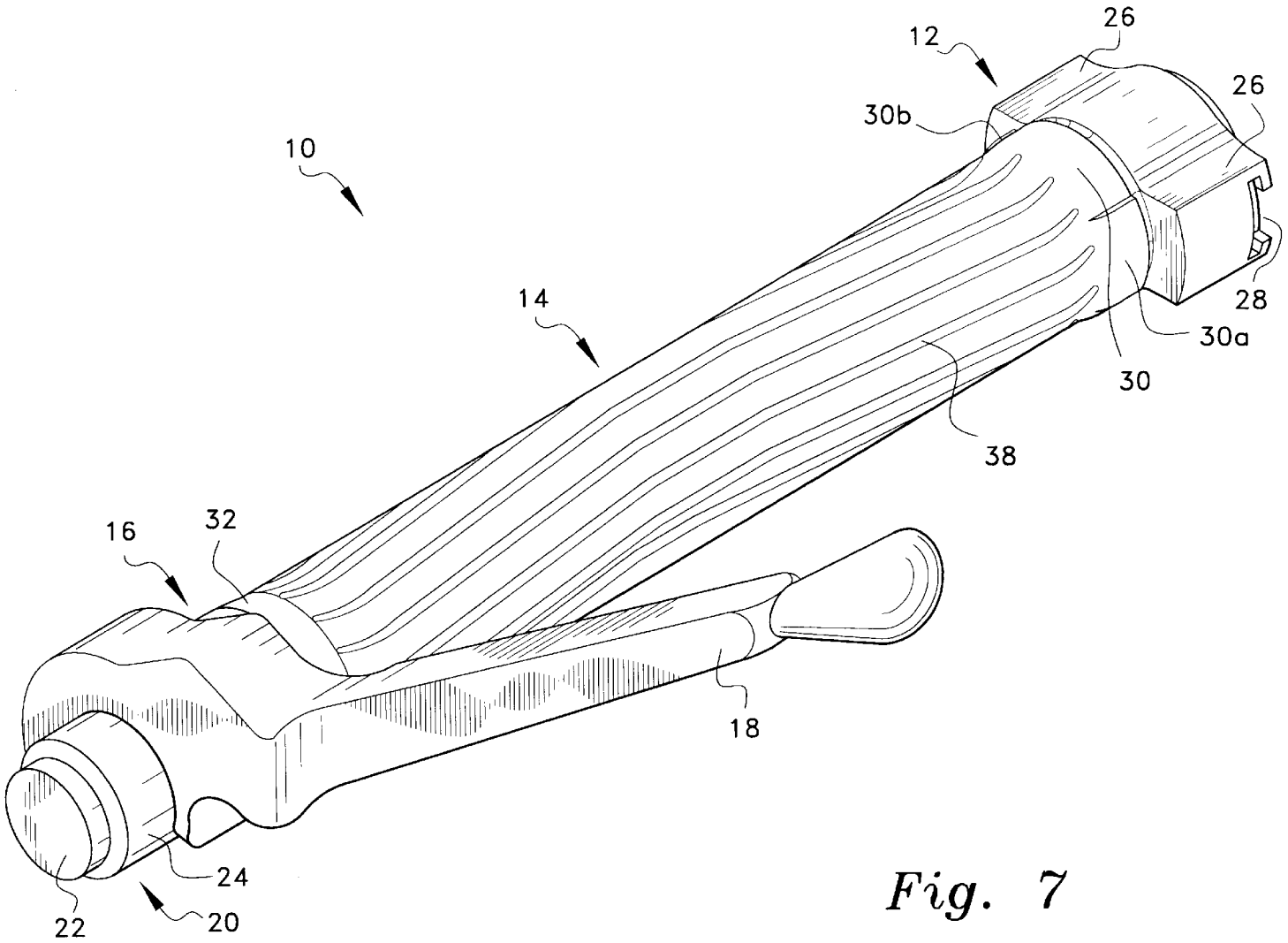
FIG. 7 is a top rear perspective view of a bolt according to the present invention.

Referring to FIG. 7, a bolt 10 is illustrated. The bolt 10 includes a front portion 12, a central portion 14, and a rear portion 16. The rear portion 16 includes a bolt handle 18, which is grasped by the shooter for reciprocating the bolt 10. Firing pin assembly 20 extends centrally through the entire length of bolt 10, protruding from rear portion 16. Firing pin assembly 20 includes firing pin 22, extending through the entire length of bolt 10, and firing pin sleeve 24, threadedly attached to the rear portion 16 of bolt 10. Firing pin 22 protrudes from firing pin sleeve 24, thereby providing a visual indicator to the cocked or uncocked condition of the firing pin 22. The front portion 12 includes locking lugs 26. Although two locking lugs 26 are illustrated, other numbers are commonly used, and the present invention will work with any number of locking lugs 26. One locking lug 26 includes extractor 28.

The bolt 10 of the present invention includes front boss 30, located in front portion 12 immediately behind locking lugs 26, and rear boss 32, located in rear portion 16, directly in front of bolt handle 18, and encircling the bolt 10. Rear boss 32 has a slightly larger diameter than the central portion 14, and this diameter is uniform around the entire circumference of the bolt 10. The rear boss' diameter is preferably a maximum of 0.001 inch less than the diameter of the bolt runway 34 (FIGS. 1–6), providing for a clearance of less than or equal to 0.0005 inch between the rear boss 32 and bolt runway 34. The diameter of rear boss 32 will vary with the caliber and action size of the rifle 36 (FIGS. 1–6), but a suggested example diameter is 0.7015 inch.

The front boss 30 includes raised sections 30*a*,30*b* each located directly behind each locking lug 26, and has a major diameter defined by the raised sections 30*a*,30*b* equal to the diameter of the rear boss 32. Raised sections 30*a*,30*b* are axially aligned with and preferably directly behind locking lugs 26, and are preferably equal in width to locking lugs 26, although smaller width front boss sections may be successfully used. Between the locking lugs and front boss sections 30*a*,30*b*, front portion 12 has a minor diameter equal to the diameter of the bolt's central portion 14. Like the rear boss 32, the major diameter of front boss 30 is preferably a maximum of 0.001 inch less than the diameter of the bolt runway 34, thereby providing for a maximum of 0.0005 inch of clearance between the front boss 34 and bolt runway 30.

It should be noted that, although the most desirable difference in diameter between the bosses 30,32 and bolt runway 34 is less than 0.001 inch, the inventor can successfully utilize bosses 30,32 being as much as 0.0015 inch less in diameter than bolt runway 34.

The central portion 14 of bolt 10 may include flutes 38, having the primary purpose of improving the appearance of rifle 36. The flutes 38 may serve the additional purpose of pushing foreign debris out of the action. The flutes 38 should not be straight, because the propensity of straight flutes to increase binding when foreign matter is present in the action is well known. The illustrations show flutes 38 having a wavelike pattern. Spiral flutes, herringbone style flutes, and unfluted bolts have all been found to work well with the present invention.

FIGS. 1–6 illustrate the bolt in conjunction with a bolt action rifle 36. The rifle includes the well-known components of a barrel 46, stock 48, and bolt runway 34, with the bolt 10 being one component of bolt runway 34.

Figure 1:
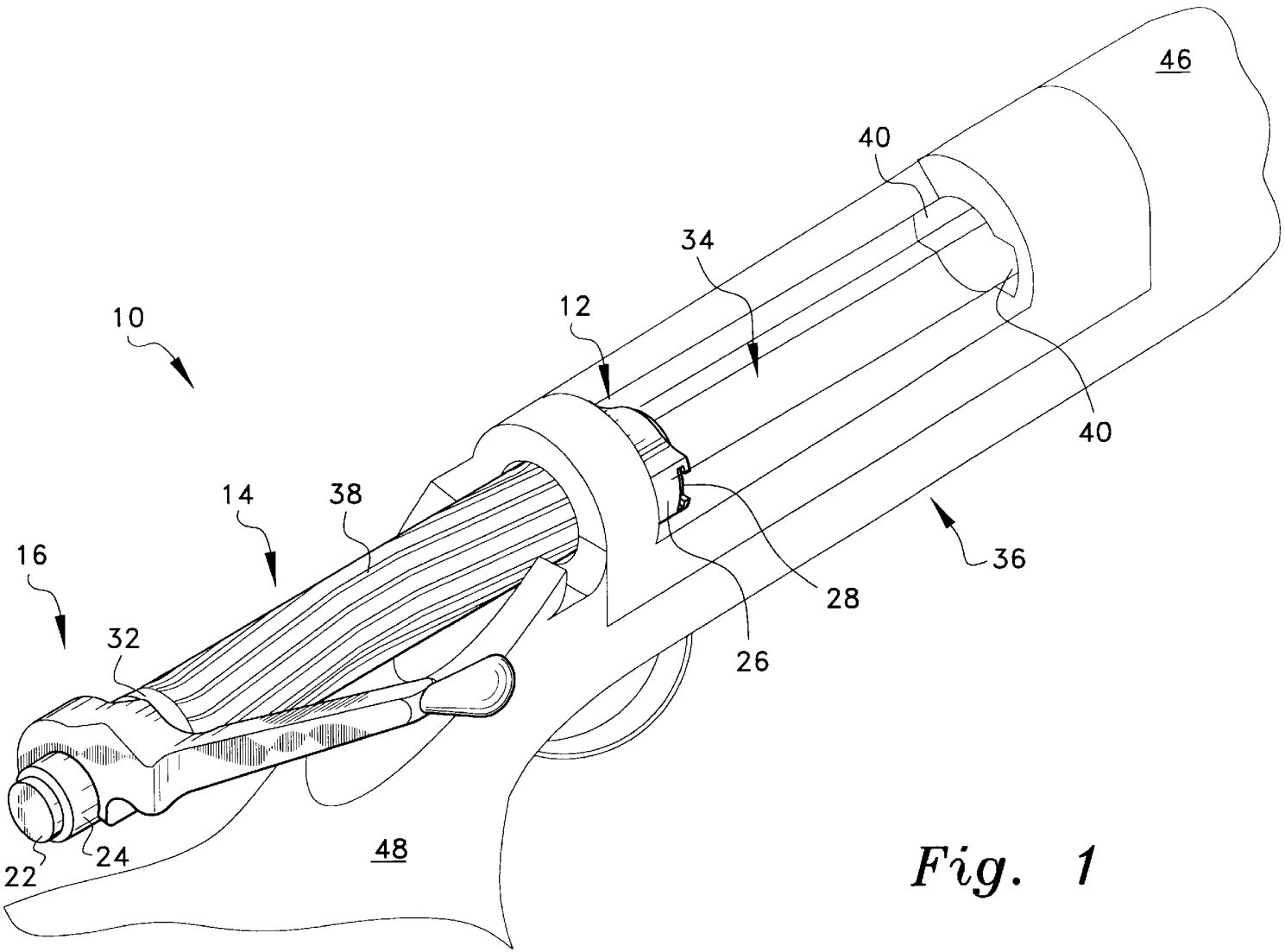
FIG. 1 is an environmental, top rear perspective view of a bolt for a firearm according to the present invention, showing the bolt in the open position.

In use, a bolt 10 having front boss 30 and rear boss 32 will increase the clearance between the bolt 10 and bolt runway 34 while the action is reciprocating, and decrease this clearance when the bolt is closed and the rifle 36 is ready to fire. Referring to FIG. 1, a rifle 36 is shown with bolt 10 in the fully open position, as it would be after ejecting a spent cartridge casing or before loading the chamber. In this position, rear boss 32 is outside of bolt runway 34, so that the clearance between the bolt's center section 14 and bolt runway 34 determines the bolt's clearance. Likewise, locking lugs 26 are aligned with the locking lug channels 40, so that the clearance between the front portion 12 of bolt 10 is determined by the minor diameter of bolt 10. Therefore, clearance between bolt 10 and bolt runway 34 is maximized, minimizing any tendency for binding.

Figure 2:
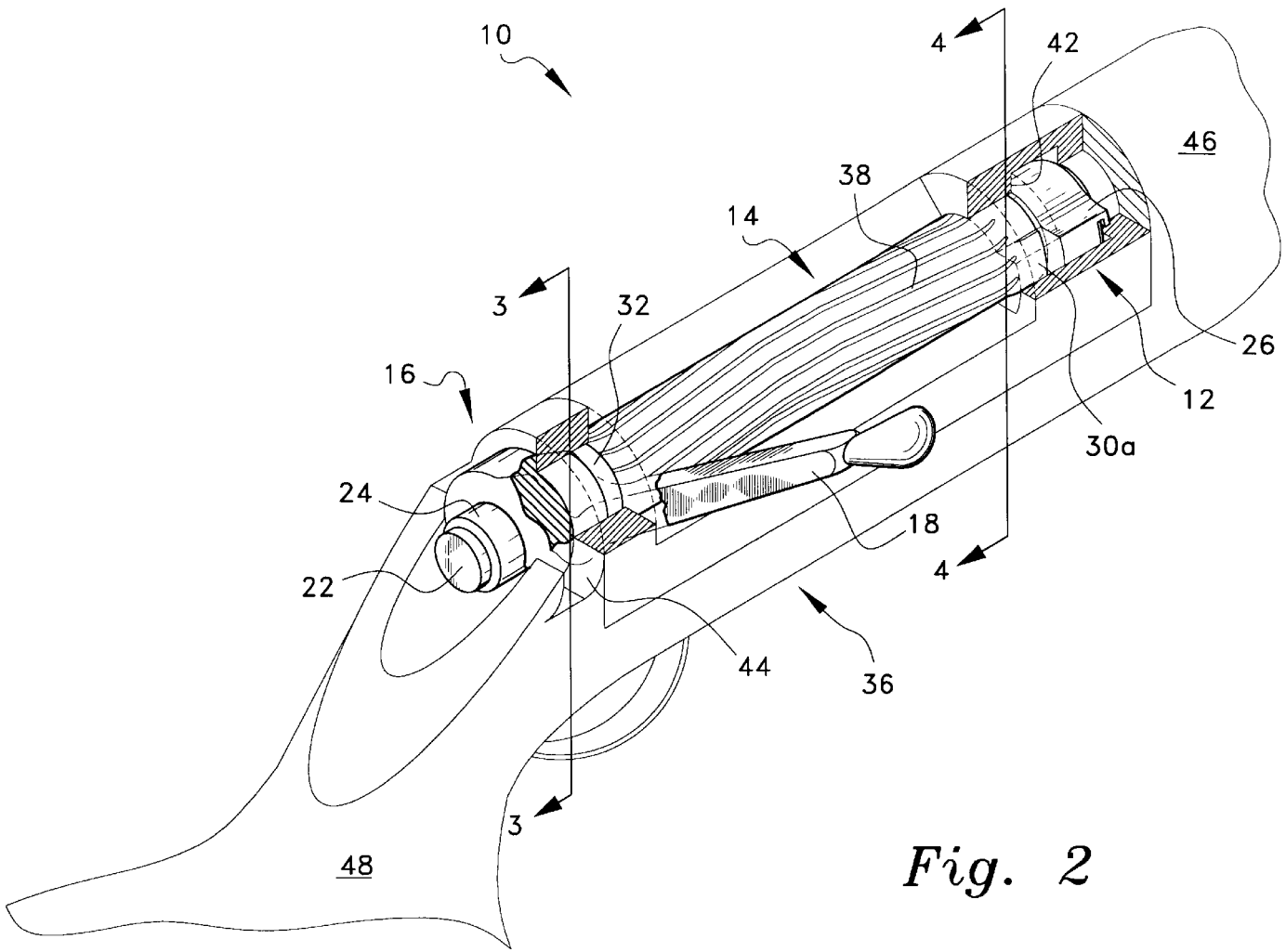
FIG. 2 is an environmental, top rear perspective view of a bolt for a firearm according to the present invention, showing the bolt pushed forward but not rotated downwards to lock it closed.
Figure 3:
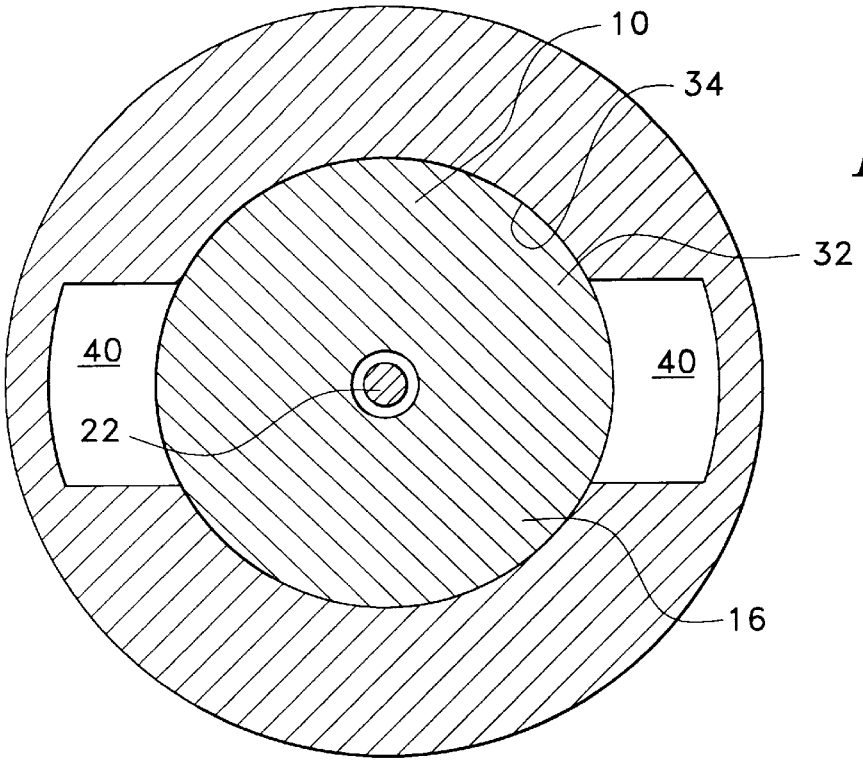
FIG. 3 is a cross sectional view along lines 3—3 in FIG. 2, showing the close fit between the rear boss and bolt runway.

When the bolt is pushed forward into the position shown in FIG. 2, as it would be to chamber a cartridge from a magazine or ramp (not illustrated, and well-known) or after manually inserting a cartridge into the chamber (not illustrated), rear boss 32 enters bolt runway 34, thereby reducing the clearance between bolt 10 and bolt runway 34. FIG. 2 illustrates bolt 10 in a forward but unlocked position, with handle 18 remaining upward as in FIG. 1. Referring briefly to FIG. 3, the position of rear boss 32 within bolt runway 34 is illustrated. There is very little clearance between rear boss 32 and bolt runway 34, thereby preventing movement of the rear portion 16 of bolt 10 within bolt runway 34.

Figure 4:
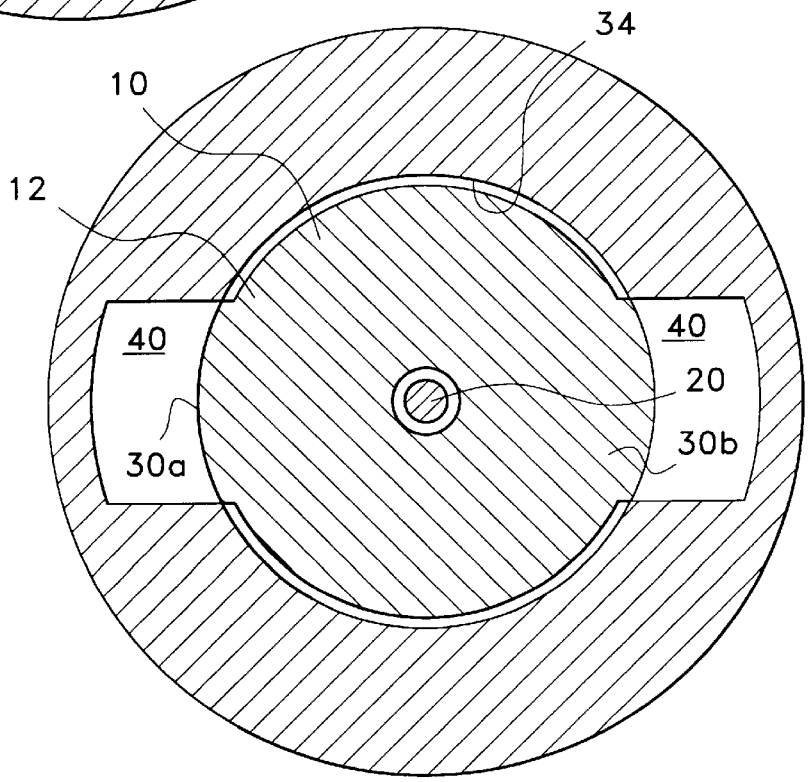
FIG. 4 is a cross sectional view along the lines 4—4 in FIG. 2, showing the fit between the front boss and bolt runway with the bolt rotated to the unlocked position shown in FIG. 2.

Referring briefly to FIG. 4, the position of the front boss 30 relative to bolt runway 34 and locking lug channels 40 is illustrated when the bolt is in the position shown in FIGS. 1 and 2. Both raised sections 30*a*, 30*b* of front boss 30 are adjacent to locking lug channels 40, so that there is maximum clearance between the front portion 12 of bolt 10 and bolt runway 34. Therefore, when the bolt is positioned as shown in FIG. 2, the rear portion 16 has been secured against side to side movement by rear boss 32, but the front portion 12 is still positioned so that front boss 30 allows for maximum clearance between the bolt 10 and bolt runway 34.

Figure 5:
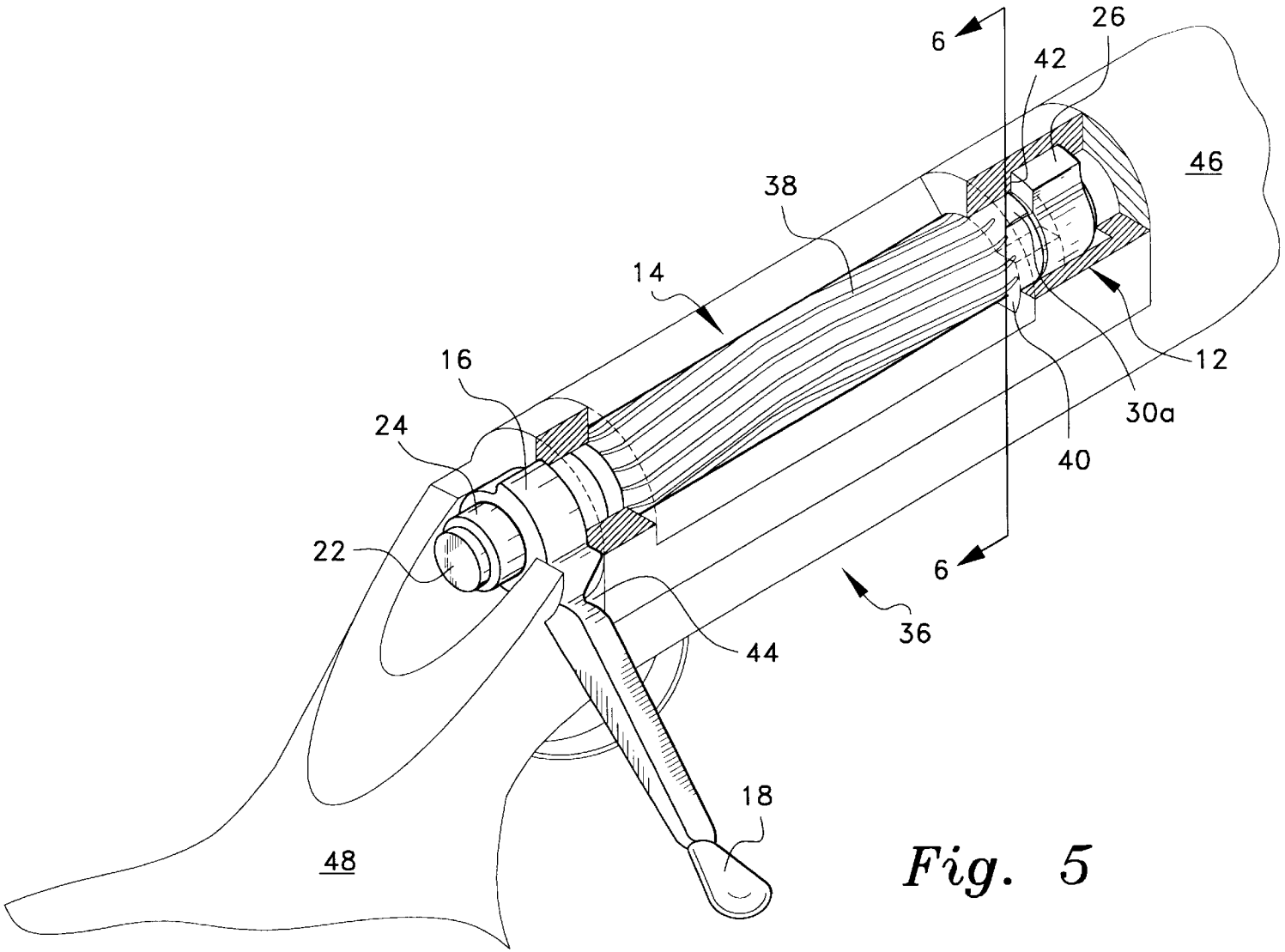
FIG. 5 is an environmental, top rear perspective view of a bolt for a firearm according to the present invention, showing the bolt in the fully closed position.
Figure 6:
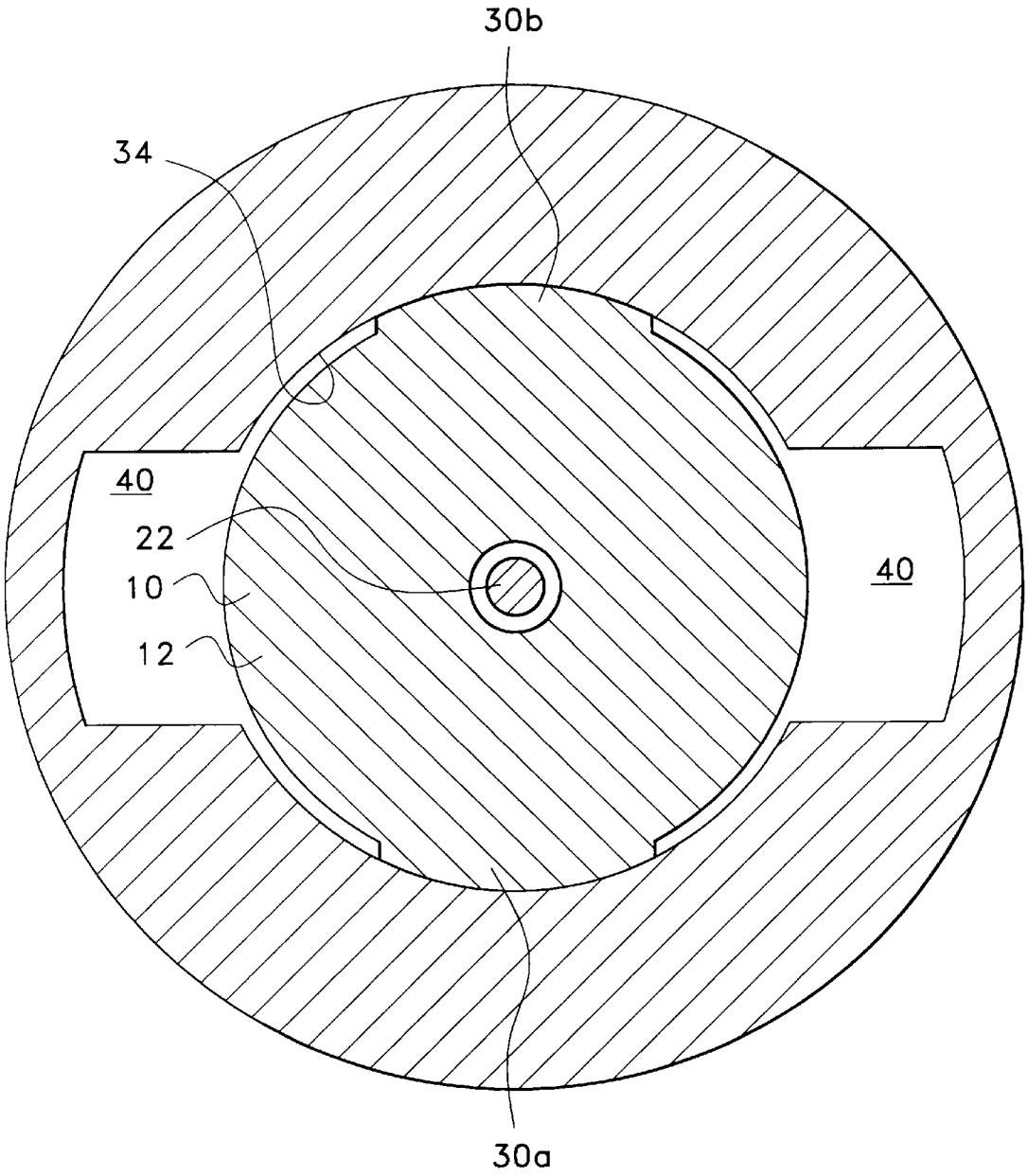
FIG. 6 is a cross sectional view along the lines 6—6 in FIG. 5, showing the close fit between the front boss and the bolt runway with the bolt rotated to the locked position.

Referring to FIG. 5, the bolt is illustrated in its fully closed position, wherein handle 18 has been rotated downward from its position in FIG. 2. Rotating the bolt handle 18 downward moves the locking lugs 26 from their horizontal position to their vertical position. The bolt is thereby firmly secured in position primarily by the locking lugs 26 positioned against lug bearing surfaces 42, and to a lesser extent by the bolt handle 18 fitting within handle slot 44. Referring briefly to FIG. 6, the new orientation of the front boss 30 is illustrated. As the locking lugs 26 were rotated into a vertical position, front boss 30 was also rotated to a vertical position, thereby removing it from contact with the locking lug channels 40, and reducing the clearance between front boss 30 and bolt runway 34. Bolt 10 is now secured against lateral play at both front portion 12 and rear portion 16, thereby improving the accuracy of the rifle 36.

The procedure is reversed when opening the bolt 10, as would be done either to eject a spent cartridge casing, or to verify the status of the chamber. Beginning with FIGS. 5 and 6, the bolt begins with bolt handle 18 within handle slot 44, locking lugs 26 positioned against lug bearing surfaces 42, and front boss 30 rotated in a vertical position wherein it bears against the bolt runway 34. Rotating bolt handle 18 upward (FIGS. 2–4) rotates the locking lugs 26 and front boss 30 into a horizontal position wherein they are aligned within locking lug channels 40, thereby increasing the clearance between the bolt's front end 12 and the bolt runway 34. Pulling bolt handle 18 rearward (FIG. 1) removes rear boss 32 from bolt runway 34, thereby increasing the clearance between the rear portion 16 of bolt 10 and bolt runway 34. The bolt 10 now has maximum clearance between itself and bolt runway 34, preventing binding between bolt 10 and bolt runway 34.

It is to be understood that the present invention is not limited to the embodiment described above, but encompasses any and all embodiments within the scope of the following claims.

I claim:

1. A bolt for a bolt action firearm, the firearm having a bolt runway, the bolt runway having a diameter and including a number of locking lug channels, said bolt comprising:

a front portion having a plurality of locking lugs corresponding to the number of locking lug channels, each of the number of locking lugs having a width, and a front boss having a plurality of raised sections corresponding to the number of locking lugs, each of said plurality of raised sections having a width and being axially aligned with each of said plurality of locking lugs, said front portion further having a major diameter defined by said plurality of raised sections, and a minor diameter corresponding to said front boss between said raised sections;

a rear portion having a bolt handle and a rear boss, said rear boss encircling said bolt and having a diameter; and a central portion extending between said front portion and said rear portion, said central portion having a diameter smaller than the major diameter of said front boss and the diameter of the rear boss, wherein the diameter of the rear boss is equal to the major diameter of the front boss.

2. The bolt according to claim 1, wherein the width of each of said plurality of raised sections is equal to the width of each of said locking lugs.

3. The bolt according to claim 1, wherein the difference between said bolt runway's diameter and said front boss' major diameter is less than 0.0015 inch.

4. The bolt according to claim 1, wherein each of said plurality of raised sections is directly behind each of said plurality of locking lugs.

5. The bolt according to claim 1, wherein said rear boss is in front of said handle.

6. The bolt according to claim 1, wherein said central portion is fluted.

7. The bolt according to claim 6, wherein said flutes have a wavelike pattern.

8. The bolt according to claim 6, wherein said flutes have a spiral pattern.

9. The bolt according to claim 6, wherein said flutes have a herringbone pattern.

* * * * *